United States Patent [19]

Chabrol et al.

[11] Patent Number: 4,678,233

[45] Date of Patent: Jul. 7, 1987

[54] ARMCHAIR, PARTICULARLY FOR HANDICAPPED PERSONS, EQUIPPED WITH A DEVICE FOR RAPIDLY LOCKING THE FOOT REST

[75] Inventors: Jean-Jacques Chabrol, Gironde; Jean-Pierre Lambert, Indre et Loire, both of France

[73] Assignees: Composites Aquitaine S. A.; Etablissements Poirier S.A., both of France

[21] Appl. No.: 860,365

[22] Filed: May 6, 1986

[30] Foreign Application Priority Data

May 7, 1985 [FR] France ..... 85 06913

[51] Int. Cl.[4] ..... A47C 7/50

[52] U.S. Cl. ..... 297/429; 297/DIG. 4

[58] Field of Search ..... 297/429, 433, DIG. 4

[56] References Cited

U.S. PATENT DOCUMENTS

| | | | |
|---|---|---|---|
| 3,453,027 | 7/1969 | Pivacek | 297/429 |
| 3,854,774 | 12/1974 | Limpach | 297/429 |
| 4,572,576 | 2/1986 | Minnebraker | 297/429 |

FOREIGN PATENT DOCUMENTS

| | | | |
|---|---|---|---|
| 783419 | 4/1968 | Canada | 297/429 |
| 1185160 | 11/1966 | United Kingdom . | |
| 1153036 | 5/1969 | United Kingdom . | |
| 1565986 | 4/1980 | United Kingdom | 297/429 |

*Primary Examiner*—James T. McCall

*Attorney, Agent, or Firm*—Armstrong, Nikaido, Marmelstein & Kubovcik

[57] ABSTRACT

The invention provides an armchair on which is retractably fixed at least one foot rest pivoting with respect to the frame of the armchair.

According to the invention, the foot rest is locked against rotation, in its service position, by means of a rotary cam which cooperates with the adjacent upright of the frame, this cam being locked by means of a locking finger. The cam and the locking finger are mounted on one of the lateral faces of the foot rest.

5 Claims, 4 Drawing Figures

ARMCHAIR, PARTICULARLY FOR HANDICAPPED PERSONS, EQUIPPED WITH A DEVICE FOR RAPIDLY LOCKING THE FOOT REST

BACKGROUND OF THE INVENTION

The invention relates to an armchair, particularly for handicapped persons, equipped with a device for rapidly locking the foot rests. It relates more precisely to an armchair whose foot rest or foot rests are mounted for pivoting with respect to the frame of the armchair so as to be able to be retracted, and thus to facilitate access to the armchair or transport thereof.

Preferably, a pivoting foot rest should be locked, at least in its service position, so that it is held in this position and cannot pivot unexpectedly. Furthermore, such locking must be simple and rapid to effect.

SUMMARY OF THE INVENTION

One of the aims of the invention is then to provide an armchair equipped with a device for rapidly locking the foot rests, in their service position.

Another aim of the invention is to provide such an armchair whose foot rests are removably fixed to the frame of the armchair, the locking device also holding the foot rests on the armchair in the raised position.

The invention provides then an armchair comprising a frame mounted on wheels, on which a foot rest is retracably fixed which may pivot with respect to the frame about a pivoting axis substantially perpendicular to the bearing plane of the armchair rolling over the ground.

According to the invention, the foot rest comprises, on one of its side faces, a locking device cooperating in the service position of the foot rest with one of the uprights of the frame disposed in the path of the foot rest, so as to lock the foot rest against rotation, the locking device comprising a cam which is mounted for rotation with respect to an axis parallel to the axis of the upright and which has a lateral surface cooperating with the lateral surface of the upright, the cam being locked in the position cooperating with the lateral surface of the upright by means of a locking finger mounted on the foot rest, in the vicinity of the cam.

Preferably, the locking finger is mounted for rotation with respect to an axis parallel to the axis of the upright, and is resiliently subjected to a rotational torque in a given direction, the cam being subjected resiliently to a rotational torque in the opposite direction.

Advantageously, the upright of the frame has, in its region cooperating with the cam, a convex cylindrical shaped surface, the cam having correspondingly a concave cylindrical shaped surface.

In addition, the lateral face of the foot rest comprising the locking device has stop means which, when the foot rest is locked against rotation, are applied against corresponding stop means carried by the upright, for immobilizing the foot rest in translation in the direction of the pivoting axis.

Thus, the foot rest may be simply fitted slidably and so removably on a pivoting shaft integral with the frame, said stop means immobilizing the foot rest along this shaft.

In a preferred embodiment, the foot rest comprises two arms by the ends of which it is connected to the frame, these two arms being substantially perpendicular to the pivoting axis and one of them carrying the locking device and the stop means of the foot rest.

BRIEF DESCRIPTION OF THE DRAWINGS

Other details and advantages of the invention will be clear from the following description of one embodiment given by way of non limitative example, with reference to the accompanying Figures in which.

DESCRIPTION OF THE PREFERRED EMBODIMENT

Figure 1:
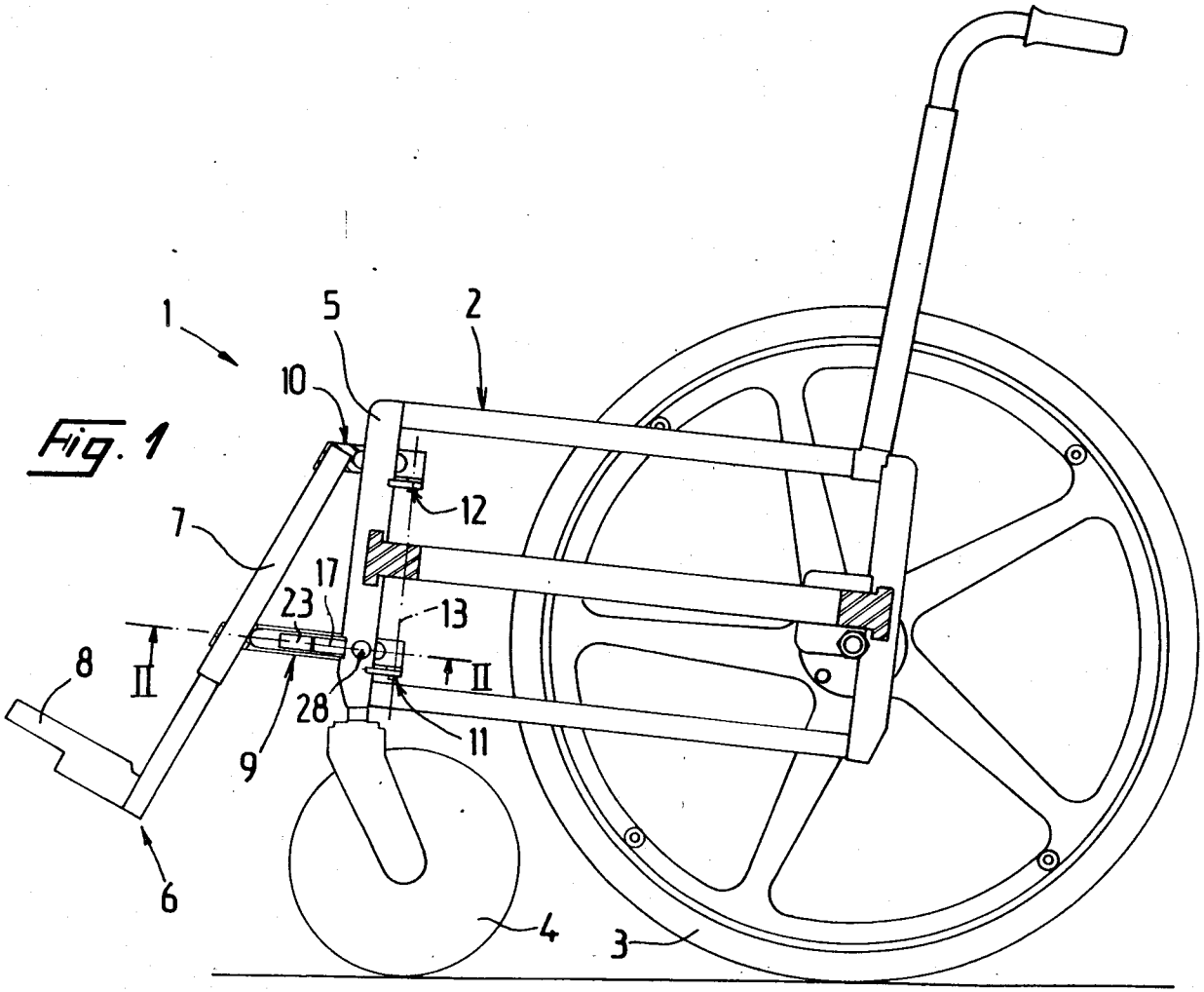
FIG. 1 is a view in longitudinal section and elevation of an armchair in accordance with the invention.

In the Figure is shown an armchair 1 comprising in a way known per se a parallelepipedic frame 2 formed of structural sections assembled together by bonding, screwing or welding. The frame 2 is mounted on four wheels, namely two large wheels 3 and two small wheels 4. FIG. 1 shows only the right hand side of the armchair cut in two lengthwise. The description relating to this Figure is therefore valid for the lefthand side of the armchair.

On the right front upright 5 of frame 2 is fixed a foot rest 6 which comprises essentially, in a way known per se, a bar or bracket 7. At one of the ends of bracket 7 is mounted perpendicularly a flat rest 8 which may be folded back against bracket 7.

The foot rest 6 comprises, also in a way known per se, two arms 9, 10 essentially non parallel to the brackets 7 which are spaced apart from and parallel to each other. The two arms 9, 10 are fixed by one end to bracket 7 and are mounted for pivoting at the other end on two respective studs 11, 12 aligned along the same geometrical pivoting axis 13. The pivoting axis 13 is parallel to the front upright 5 of frame 2, that is to say perpendicular to the bearing plane of armchair 1 on the ground; it is set back with respect to the front face and to the front upright 5 of frame 2, but outside the frame 2 with respect to the right hand side thereof.

Thus, the foot rest 6 as a whole may rotate about pivoting axis 13 so as to be folded back against the right hand side of frame 2. When the foot rest is in the service position, as shown in the Figures, its lower arm 9 comes against the front upright 5 which is disposed in the pivoting path of this arm.

Figures 2, 3, 4:
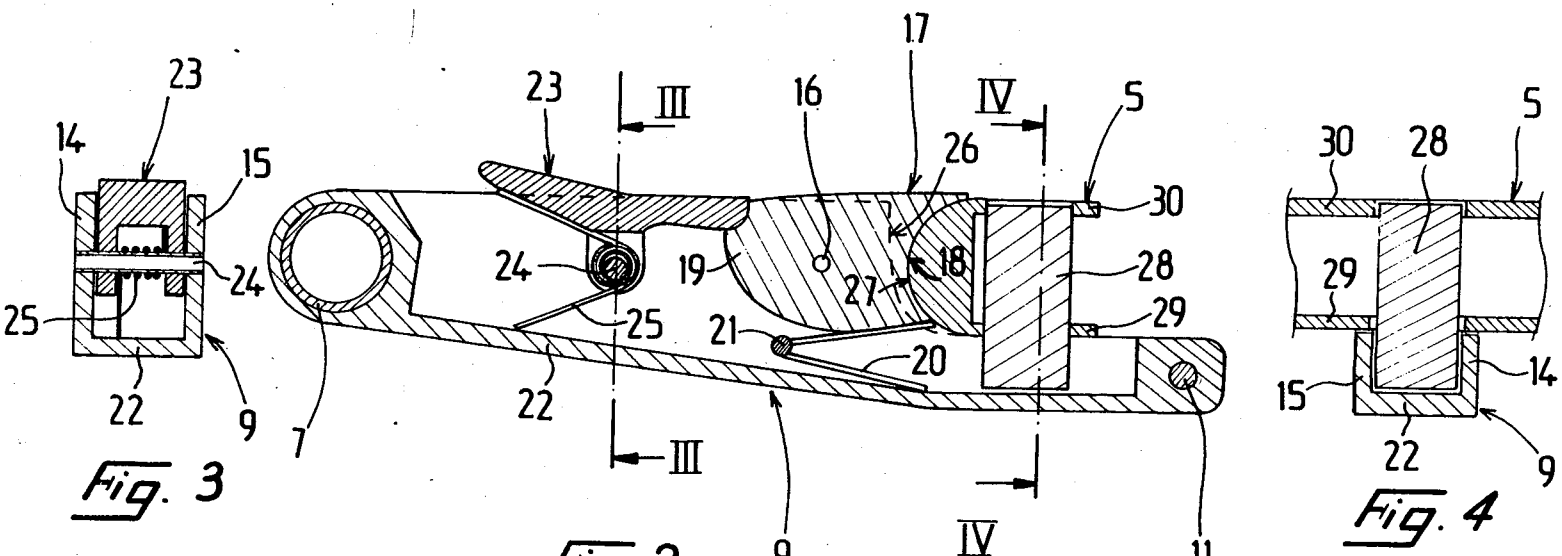
FIG. 2 is a sectional view through line II—II of FIG. 1.
FIG. 3 is a sectional view through line III—III of FIG. 2.
FIG. 4 is a sectional view through line IV—IV of FIG. 2.

In accordance with the invention, the lower arm 9 of foot rest 6 has, in its central part, a U shaped section (FIG. 3). Its branches 14, 15 are perpendicular to the pivoting axis 13 and it is turned, in the service position of foot rest 6, towards the front upright 5. The lower arm 9 has in its two branches 14, 15, on the stud 11 side, a recess 26 for receiving the front upright 5.

Between the branches 14, 15 of the lower arm 9 and on the stud 11 side, is mounted a cam 17 for rotating about a pin 16 which passes therethrough in its central part. Its pin 16 is perpendicular to the branches 14, 15 of the lower arm 9, so parallel to the axis of the front upright 5 and to the pivoting axis 13 of the foot rest 6. This cam 17 has a lateral surface portion 18 which has a concave cylindrical shape and which is turned towards stud 11. It also has an axially directed shoulder 19 which is substantially diametrically opposite the concave cylindrical portion 18. Cam 17 is subjected to a rotational torque (in an anticlockwise direction, such as shown in FIG. 2) by means of a torsion spring 20 disposed on a shaft 21 parallel to the pin 16 of cam 17, between this cam and the base 22 of the lower arm 9. One of the ends of the torsion spring 20 bears against cam 17 and the other end against the base 22 of the lower arm 9.

Inside the lower arm 9 of the foot rest 6 and on the same side as bracket 7 a locking finger 23 is also mounted for rotation about a pin 24 perpendicular to its branches 14, 15. This locking finger 23 extends lengthwise along the lower arm 9, essentially on the open side of the lower arm 9. The axis of rotation 24 of the locking finger 23 is disposed in its central part so that the locking finger 23 may pivot about the rotational pin 24. On the rotational pin 24 is mounted a torsion spring 25, similarly to that of cam 17, but so that the locking finger 23 is subjected to a rotational torque in a clockwise direction (FIG. 2).

Thus, cam 17 and locking finger 23 are caused to pivot towards one another, the end of the locking finger 23 then coming into abutment against shoulder 19 of cam 17; thus, the locking finger 23 and cam 17 are immobilized.

The front upright 5 of the frame has, at least in its region intended to cooperate with the lower arm 9, a generally U shaped section. The base of this U is rounded so as to form a surface portion 27 of convex cylindrical shape corresponding to the concave cylindrical shape of the cylindrical portion 18 of said cam 17. Furthermore a cylindrical pin 28 is mounted through the two branches 29, 30 of the front upright 5. It projects on the side of the upright intended to cooperate with the lower arm 9 of the foot rest 6. The diameter of pin 28 is slightly less than the distance separating the two branches 14, 15 of the lower arm 9.

The cam 17 and the locking finger 23 described above form a device for locking the foot rest 6 in its service position shown in the Figures. To obtain this locking, foot rest 6 is folded down from its retracted position in which it is disposed on the side of frame 2, for placing it in its service position.

In this movement, the front upright 5 is applied against the cylindrical portion 18 of cam 17, and rotates cam 17 until the branches 14, 15 of the lower arm 9 come into abutment against the front upright 5. Locking finger 23 then locks cam 17 in its final position.

Arm 9 is therefore locked against rotation, since cam 17 is forcibly applied against the front upright 5 by its cylindrical portion 18.

For unlocking the foot rest 6, a pressure is exerted on the locking finger 23 for freeing cam 17, then the foot rest 6 is pushed laterally so as to move it away from the front upright 5.

According to the invention, when the lower arm 9 is folded back against the front upright 5, it covers the projecting end of pin 28 fixed through the front upright 5. Thus, the lower arm 9 and so the whole of the foot rest 6 are locked against translation in the direction of the pivoting axis 13 of the foot rest 6: in fact the end of pin 28 is disposed between the two branches 14, 15 of the lower arm 9 and cannot move with respect to this arm. The above mentioned abutment means are therefore formed, on the one hand, by pin 28 and, on the other, by the branches 14, 15 of the lower arm 9.

Naturally, the invention also applies to a foot rest whose means of connection to chassis 2 are not arms 9, 10 but are formed for example by a continuous wall which extends along the bracket. In this case, the locking device is fixed to this wall.

What is claimed

1. In an armchair comprising a frame on which is retractably fixed at least one foot rest which may pivot with respect to said frame about a pin mounted substantially perpendicular to the bearing plane of said armchair over the ground, said foot rest comprises a locking device cooperating in the service position of the foot rest with one of the uprights of the frame disposed in the path of the foot rest to lock the foot rest against rotation, said locking device comprising a cam mounted for rotation about said pin and parallel to the axis of said upright said cam having a lateral surface for cooperation with the surface of said upright and means for locking said cam in position cooperating with said one of the uprights of said frame, said means for locking including a locking finger mounted on said foot rest for abutting said cam.

2. The armchair as claimed in claim 1, wherein said locking finger is mounted for rotation with respect to an axis parallel to the axis of said upright, and is resiliently rotated in a first direction, said cam being resiliently rotated in a direction opposite to said first direction.

3. The armchair as claimed in claim 1, or claim 2, wherein said one of the uprights of said frame has, in its region cooperating with said cam, a surface of convex cylindrical shape, said cam having correspondingly a surface of concave cylindrical shape.

4. The armchair according to any one of claims 1 to 3, wherein said locking device comprises abutement means which, when the foot rest is locked against rotation, are applied against corresponding abutment means on said upright, for locking the foot rest in translation in the direction of said pivoting axis.

5. The armchair according to any one of claims 1 to 4, wherein said foot rest comprises two arms connected to said frame, said arms being substantially perpendicular to said pivoting axis, one of said arms carrying said locking device and said abutement means of said foot rest.

* * * * *